United States Patent [19]

Halse

[11] 4,178,018

[45] Dec. 11, 1979

[54] CONTINUOUS STATIONERY ASSEMBLIES

[75] Inventor: Per W. Halse, Oslo, Norway

[73] Assignee: Moore Business Forms, Inc., Grand Island, N.Y.

[21] Appl. No.: 839,263

[22] Filed: Oct. 4, 1977

[30] Foreign Application Priority Data

Oct. 5, 1976 [GB] United Kingdom ..... 41237/76

[51] Int. Cl.[2] ..... B41L 1/20

[52] U.S. Cl. ..... 282/11.5 A; 282/12 A

[58] Field of Search ..... 282/11.5 R, 11.5 A, 282/12 R, 12 A, 12 B, 19 R, 20 R, 21 R, 24

[56] References Cited

U.S. PATENT DOCUMENTS

| | | | |
|---|---|---|---|
| 3,854,654 | 12/1974 | Van Malderghem | 282/11.5 A |
| 4,113,281 | 9/1978 | Halse | 282/11.5 A |
| 4,121,857 | 10/1978 | Halse | 282/11.5 A |
| 4,123,086 | 10/1978 | French | 282/11.5 A |

*Primary Examiner*—Gerald A. Dost

*Attorney, Agent, or Firm*—Watson, Cole, Grindle & Watson

[57] ABSTRACT

A continuous stationery assembly particularly intended for use with typewriters, terminal printers, mini-computers and so on, whether or not such devices embody pin feed driving mechanisms, wherein the assemblies are fed through the machine and refolded effectively, comprising a front and a back outer record web, both with marginal feed apertures, at least one intermediate web with transfer material associated with it, respectively secured to the web next above it, and wherein the two outer webs extend beyond the longitudinal side edges of the intermediate web to form side margins at opposite sides of the assembly, securing means within the respective margins joining the front and back webs together and a further securing means joining the intermediate web to at least one of the outer record webs, longitudinal lines of perforations in the front and back webs adjacent the side edges of the intermediate record web to facilitate removal of the margins and longitudinal lines of perforations in each of said webs to facilitate separation of the webs from the transfer material.

5 Claims, 7 Drawing Figures

CONTINUOUS STATIONERY ASSEMBLIES

Figure 1:
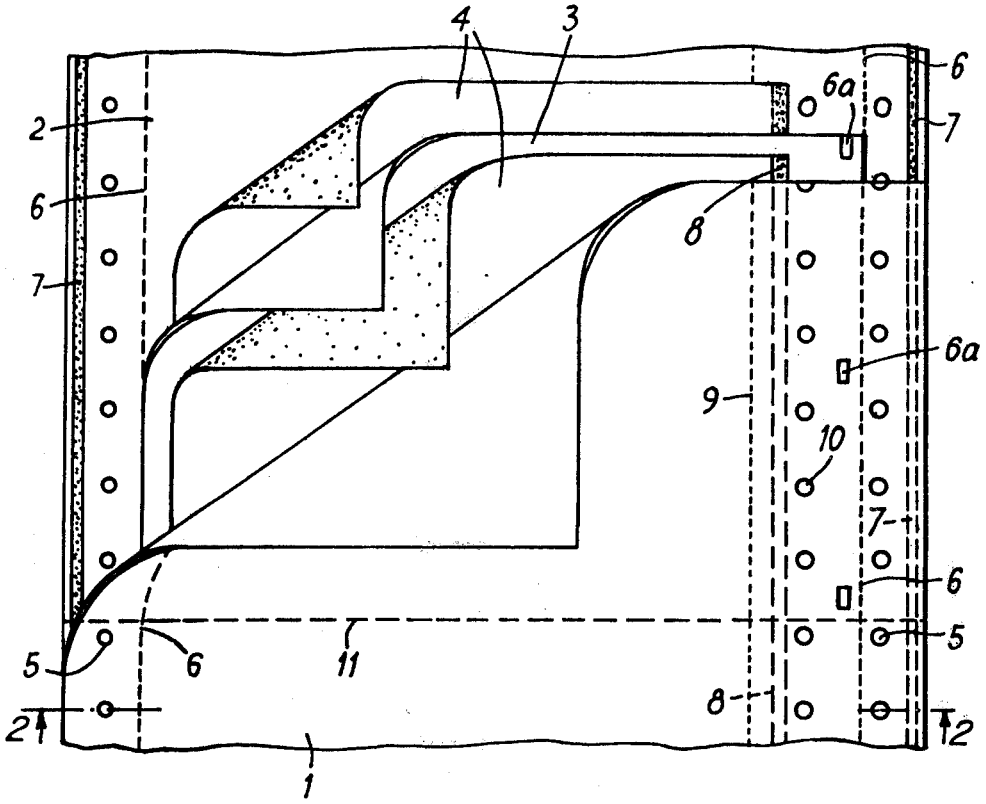

This invention relates to continuous stationery assemblies, and is more particularly intended for use on typewriters, terminal printers, mini-computers and high speed printers.

"Snap-out" sets have been known for many years and comprise interleaved record sheets and transfer sheets (usually carbon paper) pasted together at one edge, usually the top edge, to form a stub with the record sheets extending beyond the transfer sheets at the end remote from the stub and in which the record sheet edges have a line of perforations adjacent the stub, so arranged that the record sheets and the transfer sheets can be separated by a snap-out action.

Furthermore, in British Pat. No. 502,257 there is described a snap-out set arranged in continuous form in which the stub is arranged at one side of the continuous assembly and this stub contains marginal feed apertures. Such assemblies suffer from certain disadvantages; for example, the assemblies are not found suitable for feeding through a high speed printer. In the case of the usual kinds of snap-out sets no feed apertures are provided and, in the case of the assembly described in the aforementioned U.S. Pat. No. 502,257, there are marginal feed apertures at one side only of the assembly.

Continuous stationery assemblies of many kinds have been used with devices such as typewriters, terminal printers, etc., and these assemblies have marginal feed apertures which are engaged by pin feed driving mechanisms to feed the assemblies through the devices. These assemblies usually comprise separate record webs with interleaved but unattached transfer webs, although assemblies have been proposed comprising front and back outer record webs with the intermediate record web or webs secured to one or both of the outer record webs.

Such assemblies are fed with difficulty through the devices because they are folded into packs when manufactured and when fed through the devices they are fed in a straight line and, subsequently, refolded into packs. Due to the fact that the web parts are secured together, such feeding is liable to be uneven and the packs when folded tend not be be refolded properly in that the refolded packs suffer from what is referred to as "tenting".

It is therefore an object of the present invention to provide an improved construction of continuous stationery assembly suitable for feeding through devices such as typewriters, terminal printers, mini-computers and high speed printers, whether or not such devices embody pin feed driving mechanisms whereby the assemblies are fed and refolded effectively.

According to the present invention a continuous stationery assembly comprises a front outer record web and a back outer record web, each web having marginal feed apertures and with at least one intermediate record web, the webs having transfer material associated with them to enable data applied to the front web by writing pressure to be reproduced on the intermediate web and back web, and wherein the two outer webs extend beyond the longitudinal side edges of the intermediate web to form side margins at opposite sides of the assembly, securing means within the respective margins joining the front and rear webs together, a further securing means joining the intermediate web to at least one of the outer record webs and longitudinal perforation lines in the front and back webs to facilitate removal of the margins containing the feed apertures.

Figure 2:
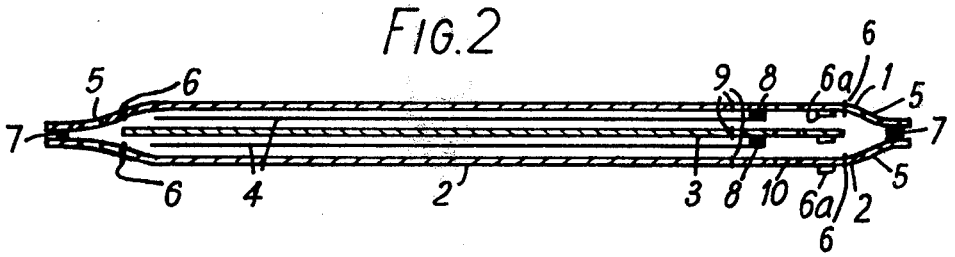
Figure 3:
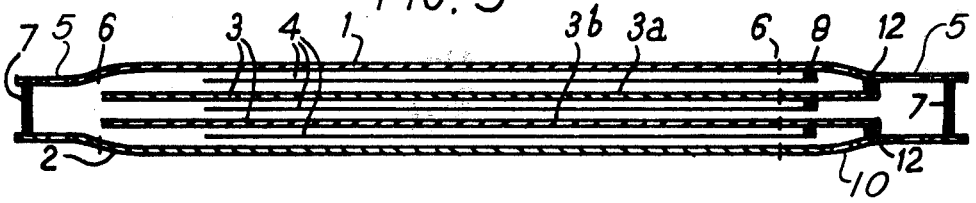
Figures 4, 5, 6, 7:
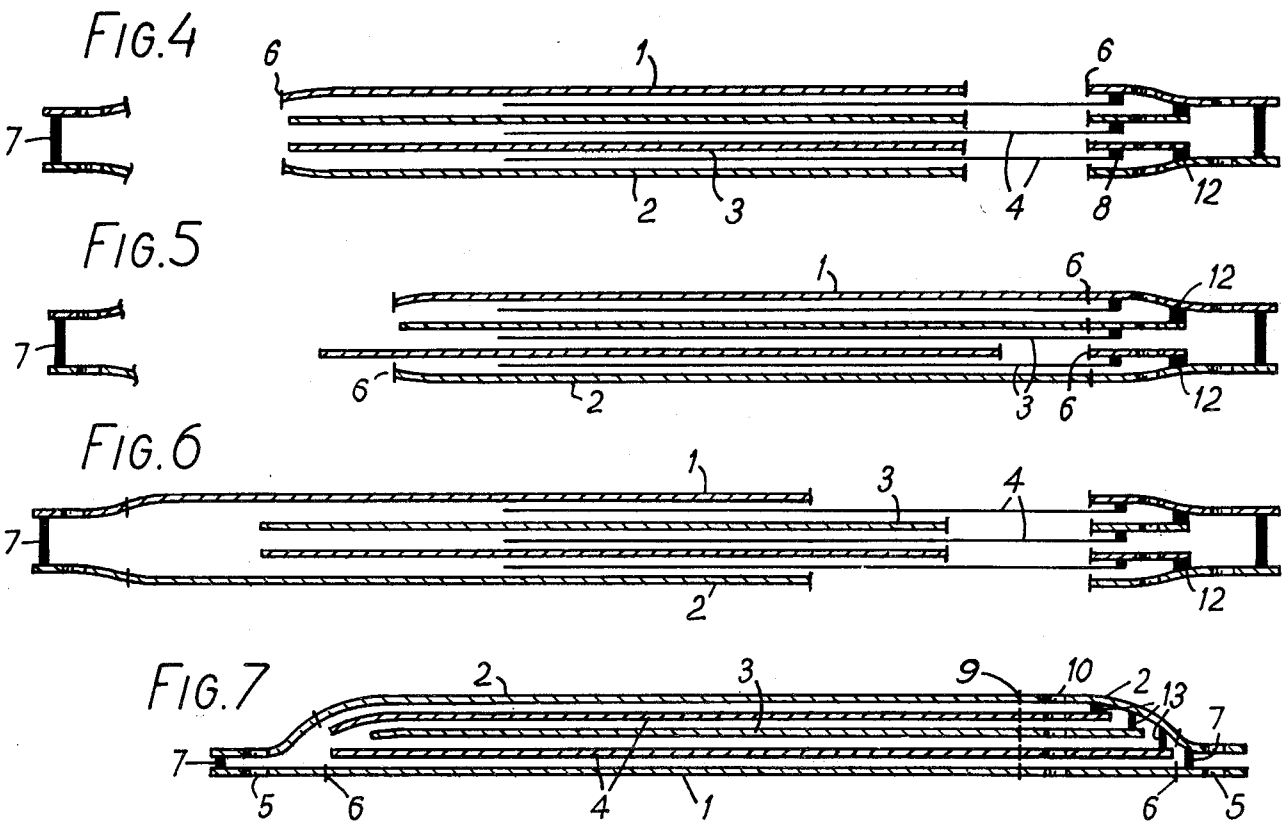

A continuous stationery assembly in accordance with the present invention will now be described by way of example with reference to the accompanying drawings wherein:

FIG. 1 is a view of a stationery assembly according to the invention with a single intermediate web and with parts folded to disclose other parts underneath, FIG. 2 is a view on a line 2—2 of FIG. 1, FIG. 3 is a view similar to FIG. 2 showing an assembly with a plurality of intermediate record webs, FIG. 4 is a view similar to FIG. 3 but with the stub part partly detached, FIGS. 5 and 6 are views of a modified assembly partly detached, and, FIG. 7 shows a further modification of the invention.

Referring to the assembly shown in FIGS. 1 and 2, the assembly includes a front outer record web 1, a back outer record web 2 and an intermediate record web 3. Transfer material in the form of a one-time carbon transfer sheet 4 is provided between the front record web 1 and the intermediate web 3, and between the intermediate web 3 and the back web 2. Lines of marginal feed perforations 5 are provided in the opposite outer marginal edges of each of the outer record webs and lines of tear-off perforations 6 are provided just within the lines of marginal feed perforations 5 on the lefthand side of the front and back webs to enable the lefthand margins to be detached. The front and back webs are joined by longitudinal lines of adhesive 7 as shown in FIG. 1 outside the lefthand side line of feed apertures 5. A similar line of adhesive 7 joins the front and back webs on the righthand side as shown in FIG. 2 also outside the line of feed apertures. However, as an alternative this line of adhesive on the righthand side may be positioned within the line of feed apertures 5.

The intermediate record web 3 is not as wide as the outer record webs and the lefthand side of the web terminates in line with the line of tear-off perforations 6 in the outer webs 1 and 2. The righthand longitudinal side of the intermediate record web 3 likewise terminates short of the outer margins of outer webs 1 and 2 within the marginal feed apertures 5 and in line with the outer line of tear off perforations 6. In alignment with the righthand edges of the intermediate record web 3 are arranged securing means in the form of a series of paper staples 6*a* to join together the front web 1, the intermediate web 3 and the back web 2. These paper staples may be of the kind described in British Pat. No. 1,376,447. Transfer webs 4 as shown are each secured to the record webs next above by further securing means in the form of lines of adhesive 8, and lines of tear-off perforations 9 are provided in each record web to enable the record webs to be separated from the transfer webs by "snap-out" action.

An additional line of marginal feed perforations 10 is formed in the outer record webs 1, 2 and in the intermediate record web 3 but not in the carbon transfer webs 4. Lines 11 of tear-off cross perforations divide the webs into form lengths. The marginal feed perforations 10 are for guiding the parts of the assembly through a collator when the assembly is being formed.

When the assembly as aforedescribed is used it is fed through a typewriter, terminal printer, mini-computer or high speed printer, as appropriate, and data is applied to it. The marginal side edges of the forms are detached either manually or by a slitting mechanism along the lines of tear-off perforations 6 to thereby remove the marginal feed apertures. Likewise the assembly is divided into form lengths by tearing along the cross perforations 11.

When the forms are divided into form lengths, the record webs can be separated from the transfer webs by holding the stub part firmly by the righthand side of the assembly, where the record webs and transfer webs overlap but outside the lines of tear-off perforations 9, between two fingers of one hand, and holding the lefthand side parts of the record webs which extend beyond the transfer webs in the other hand and moving the two hands apart.

The stationery assembly shown in FIG. 3 is similar to the assemblies shown in FIGS. 1 & 2 but includes two intermediate record webs 3 with three transfer webs 4. Each of the transfer webs 4 is secured to the record web 1, 3 next above it by a longitudinal line of adhesive 8 and the outer record webs each has lines of feed apertures 5, 10 and the intermediate webs each have lines of feed apertures 10.

The upper intermediate web 3*a* is secured to the underside of the front record web 1 and the lower intermediate web 3*b* is secured to the upper side of the back outer record web 2 by a respective line of adhesive 12. The front record web 1 is joined to the back record web 2 at their marginal side edges by respective lines of adhesive 7. Preferably the lines of adhesive 7 are of hot melt glue and the lines of adhesive 8, 12 are of cold melt glue. It will be apparent that the two intermediate record webs are not glued together except by being joined to the outer webs which are glued together. This gives the assembly flexibility, prevents the assembly from being too stiff and gives the assembly a smoother flow through the print unit.

It will be appreciated that the construction of an assembly as shown in FIG. 3 may be processed in one of several different ways and so can be used in different systems. The assembly is first divided into form length assemblies by tearing the cross perforation lines 11 to divide the webs into sheets of a single form length. Then, as shown on the lefthand side of FIG. 4, the lefthand margin is detached as by a slitter mechanism. The record webs are then separated from the righthand side stub and from the transfer webs by breaking the lines of perforations 6 as by a snap-out action, as shown on the righthand side of FIG. 4. The parts can then be distributed as required.

If it is required to remove, for example, the second intermediate sheet, the assembly is divided into form length assemblies and the lefthand stub is detached on the lefthand side (FIG. 5). The second intermediate sheet can then be removed by tearing along the perforation line 6 on the righthand side of the second intermediate sheet. Sheets other than the second intermediate sheet may be similarly detached.

If it is required to retain the first and last parts together and to separate out the intermediate sheets, perhaps for further separation, the righthand side stub and the transfer sheets are detached by tearing along the righthand side lines of tear-off perforations 6. Having removed the transfer sheets the intermediate sheets can similarly be removed from the assembly.

Referring to the stationery assembly shown in FIG. 7, there is shown a front web 1, and a back web 2, with intermediate record webs 3, each of self-manifolding paper. The front and back webs, 1 and 2, are joined by longitudinal lines of adhesive 7 within the feed perforations 5 on the righthand side but outside the feed perforations on the lefthand side of the assembly. The righthand side edges of the intermediate webs, of which three are shown, are staggered relative to the other by having a first intermediate web wider than the second intermediate web, which is wider than the third intermediate web. These three webs are joined to the back outer web 2 by lines of adhesive 13 or, alternatively, can be joined by a single line of adhesive which overlaps the outer edges of all the three intermediate webs. In other respects the embodiment of FIG. 7 is similar to the embodiment of FIGS. 1 & 2.

If desired, the assembly of FIG. 2 can have the last part—or indeed all the parts—of self-manifolding paper, in which case there is no necessity to provide the transfer webs. Likewise, the embodiment of FIG. 7 can have webs of self-manifolding paper replaced by record webs and transfer webs secured to the record webs.

What we claim is:

1. A series-connected business form adapted to be fed through the printing means of a business machine, comprising, a pair of superimposed continuous outer webs having aligned opposed marginal edges, said webs having marginal feed strips including spaced feed holes extending along said marginal edges, said webs being directly connected together along longitudinal first connecting means lying adjacent said feed holes of said feed strips and extending along said marginal edges, a first continuous intermediate web disposed between said outer webs, said intermediate web having opposed side edges spaced inwardly of said marginal edges and of said feed holes, first lines of weakening provided in said outer webs adjacent one of said side edges, a second line of weakening provided in each of said webs inwardly of the other of said side edges, second connecting means lying between said second line of weakening and said other side edge for connecting said intermediate web to one of said outer webs, and said webs having spaced transverse lines of weakening in superimposed relationship for separating the form into individual units, whereby the form may be folded along said transverse lines before being fed through the printing means with said webs in predetermined alignment with one another, and may be refolded along said transverse lines after leaving the printing means with said webs being substantially maintained in said alignment, and whereby said webs of each said unit may be separated from one another along said first and second lines of weakening.

2. The business form according to claim 1, wherein a second continuous intermediate web is disposed between said outer webs, said second intermediate web having opposed side edges spaced inwardly of said marginal edges and of said feed holes, said first lines of weakening being adjacent one of said edges of said second web, said second line of weakening being provided in said second intermediate web inwardly of the other side edge of said second web, and said second web being connected to a first of said outer webs by third connecting means provided between said second line of weakening and said other side edge of said second web.

3. The business form according to claim 2, wherein said first outer web comprises the other of said outer webs.

4. The business form according to claim 2, wherein said first outer web comprises said one outer web, and said other side edges of said intermediate webs being out of alignment with one another.

5. The business form according to claim 1, wherein a first of said outer webs comprises a front outer web, and webs of transfer material being secured to undersurfaces of said front web and of said intermediate web by third connecting means provided between said second line of weakening and said other side edge, whereby said transfer material may be separated from said webs.

* * * * *

REEXAMINATION CERTIFICATE (651st)

United States Patent [19]

Halse

[11] B1 4,178,018

[45] Certificate Issued Mar. 17, 1987

[54] CONTINUOUS STATIONERY ASSEMBLIES

[75] Inventor: Per W. Halse, Oslo, Norway

[73] Assignee: Moore Business Forms, Inc., Grand Island, N.Y.

Reexamination Request:
No. 90/000,858, Sep. 17, 1985

Reexamination Certificate for:

| | |
|---|---|
| Patent No.: | **4,178,018** |
| Issued: | **Dec. 11, 1979** |
| Appl. No.: | **839,263** |
| Filed: | **Oct. 4, 1977** |

[30] Foreign Application Priority Data

Oct. 5, 1976 [GB] United Kingdom ..... 41237/76

[51] Int. Cl.[4] ..... B41L 1/20

[52] U.S. Cl. ..... 282/11.5 A; 282/21 R

[58] Field of Search ..... 282/11.5 A, 11.5 R, 282/12 R, 21 R; 229/69

[56] References Cited

U.S. PATENT DOCUMENTS

| | | |
|---|---|---|
| 2,178,103 | 10/1979 | Johnson . |
| 2,328,081 | 8/1943 | Johnson . |
| 2,400,356 | 5/1946 | Kerr et al. . |
| 2,503,680 | 4/1950 | Newman . |
| 2,907,585 | 10/1959 | Sornberger et al. . |
| 3,104,799 | 9/1963 | Steidinger . |
| 3,305,247 | 2/1967 | Fulk . |
| 3,339,827 | 9/1967 | Steidinger . |
| 3,554,438 | 1/1971 | Van Maldergham . |
| 3,854,654 | 12/1984 | Van Maldergham . |
| 3,877,728 | 4/1975 | Herz . |
| 3,916,051 | 10/1975 | Wakeman . |
| 3,941,308 | 3/1976 | DiGirolomo et al. . |
| 4,000,916 | 1/1977 | Lucas . |
| 4,002,290 | 1/1977 | Van Maldergham . |
| 4,032,065 | 6/1977 | Heimann . |
| 4,095,695 | 6/1978 | Steidinger . |
| 4,108,352 | 8/1978 | Peschke . |
| 4,113,281 | 9/1978 | Halse . |
| 4,121,857 | 10/1978 | Halse . |
| 4,123,086 | 10/1978 | French . |
| 4,168,851 | 9/1979 | Halse . |
| 4,178,018 | 12/1979 | Halse . |

FOREIGN PATENT DOCUMENTS

| | | |
|---|---|---|
| 829450 | 1/1952 | Fed. Rep. of Germany . |
| 1042612 | 11/1958 | Fed. Rep. of Germany . |
| 974026 | 8/1960 | Fed. Rep. of Germany . |
| 1105889 | 5/1961 | Fed. Rep. of Germany . |
| 1172283 | 6/1964 | Fed. Rep. of Germany . |
| 1174807 | 7/1964 | Fed. Rep. of Germany . |
| 1256659 | 12/1967 | Fed. Rep. of Germany . |
| 1957983 | 5/1971 | Fed. Rep. of Germany . |
| 1461492 | 12/1966 | France . |
| 97462 | 2/1961 | Norway . |
| 126673 | 3/1973 | Norway . |
| 501396 | 2/1939 | United Kingdom . |
| 919496 | 2/1963 | United Kingdom . |
| 988148 | 4/1965 | United Kingdom . |
| 1006662 | 10/1965 | United Kingdom . |
| 1128634 | 9/1968 | United Kingdom . |
| 1154048 | 6/1969 | United Kingdom . |
| 1221969 | 2/1971 | United Kingdom . |
| 1286864 | 8/1972 | United Kingdom . |
| 1329063 | 9/1973 | United Kingdom . |
| 1376447 | 12/1974 | United Kingdom . |
| 1417683 | 12/1975 | United Kingdom . |
| 1418379 | 12/1975 | United Kingdom . |

*Primary Examiner*—Paul A. Bell

[57] ABSTRACT

A continuous stationery assembly particularly intended for use with typewriters, terminal printers, mini-computers and so on, whether or not such devices embody pin feed driving mechanisms, wherein the assemblies are fed through the machine and refolded effectively, comprising a front and a back outer record web, both with marginal feed apertures, at least one intermediate web with transfer material associated with it, respectively secured to the web next above it, and wherein the two outer webs extend beyond the longitudinal side edges of the intermediate web to form side margins at opposite sides of the assembly, securing means within the respective margins joining the front and back webs together and a further securing means joining the intermediate web to at least one of the outer record webs, longitudinal lines of perforations in the front and back webs adjacent the side edges of the intermediate record web to facilitate removal of the margins and longitudinal lines of perforations in each of said webs to facilitate separation of the webs from the transfer material.

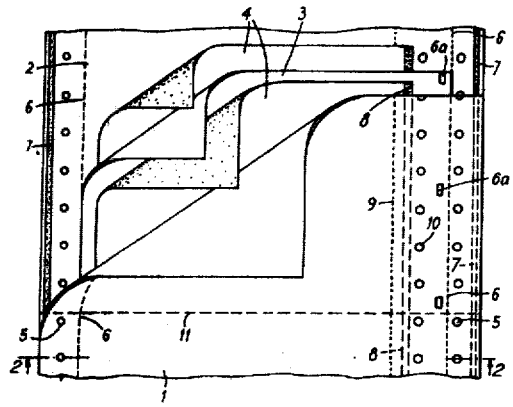

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 2–4 is confirmed.

Claims 1 and 5 are cancelled.

* * * * *